US005709975A

United States Patent [19]

Yoerger et al.

[11] Patent Number: 5,709,975

[45] Date of Patent: Jan. 20, 1998

[54] COATED HARD FERRITE CARRIER PARTICLES

[75] Inventors: William Edward Yoerger, Rochester; Wayne Thomas Ferrar, Fairport, both of N.Y.

[73] Assignee: Eastman Kodak Company, Rochester, N.Y.

[21] Appl. No.: 685,124

[22] Filed: Jul. 23, 1996

[51] Int. Cl.[6] ..... G03G 9/113

[52] U.S. Cl. ..... 430/106.6; 430/105; 430/137

[58] Field of Search ..... 430/106.6, 108, 430/137

[56] References Cited

U.S. PATENT DOCUMENTS

| | | | |
|---|---|---|---|
| 4,027,073 | 5/1977 | Clark | 428/412 |
| 4,882,258 | 11/1989 | Ikeuchi et al. | 430/109 |
| 4,977,054 | 12/1990 | Honjo et al. | 430/108 |
| 5,068,301 | 11/1991 | Okamura et al. | 528/15 |
| 5,200,287 | 4/1993 | Ohmura et al. | 430/108 |
| 5,514,511 | 5/1996 | Iwamoto et al. | 430/106 |
| 5,554,478 | 9/1996 | Kuramoto et al. | 430/109 |

FOREIGN PATENT DOCUMENTS

| | | |
|---|---|---|
| 59232362A | 12/1984 | Japan . |
| 1191155A | 8/1989 | Japan . |
| 2210365A | 8/1990 | Japan . |
| 6266169A | 9/1994 | Japan . |

*Primary Examiner*—John Goodrow
*Attorney, Agent, or Firm*—Doreen M. Wells

[57] ABSTRACT

This invention provides an electrophotographic carrier comprising hard ferrite particles, said particles having a coating comprising a silicone resin and a colloidal silica.

21 Claims, No Drawings

COATED HARD FERRITE CARRIER PARTICLES

FIELD OF THE INVENTION

The invention relates to carrier particles intended to be mixed with toner particles to form a dry electrostatographic developer. More particularly, the invention relates to an improved carrier which provides better charge stability and charging rate.

BACKGROUND OF THE INVENTION

In electrostatography, image charge patterns are formed on a support and are developed by treatment with an electrostatographic developer containing marking particles which are attracted to the charge patterns. These particles are called toner particles or, collectively, toner. The image charge pattern, also referred to as an electrostatic latent image, is formed on an insulative surface of an electrostatographic element by any of a variety of methods. For example, the electrostatic latent image may be formed electrophotographically, by imagewise photo-induced dissipation of portions of an electrostatic field of uniform strength on the surface of an electrophotographic element which comprises a photoconductive layer and an electrically conductive substrate. Alternatively, the electrostatic latent image may be formed by direct electrical formation of an electrostatic field pattern on a surface of a dielectric material.

One well-known type of electrostatographic developer comprises a dry mixture of toner particles and carrier particles. Developers of this type are employed in cascade and magnetic brush electrostatographic development processes. The toner particles and carrier particles differ triboelectrically, such that during mixing to form the developer, the toner particles acquire a charge of one polarity and the carrier particles acquire a charge of the opposite polarity. The opposite charges cause; the toner particles to cling to the carrier particles. During development, the electrostatic forces of the latent image, sometimes in combination with an additional applied field, attract the toner particles. The toner particles are pulled away from the carrier particles and become electrostatically attached, in imagewise relation, to the latent image beating surface. The resultant toner image can then be fixed, by application of heat or other known methods, depending upon the nature of the toner image and the surface, or can be transferred to another surface and then fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited on the latent image-bearing surface.

There are two basic types of carrier particles, hard and soft. Hard carrier particles are permanently magnetized while the soft carrier particles must be brought into contact with a magnet in the development station. Hard ferrites and soft ferrites have different characteristics, including surface characteristics, and coatings which may be suitable for one are not necessarily suitable for the other.

Carrier particles can comprise a core material coated with a polymer. Commonly used polymers include: silicone resin; acrylic polymers, such as, poly(methylmethacrylate); and vinyl polymers, such as polystyrene and combinations of materials. One purpose of the coating can be to reduce the tendency of toner material or other developer additives to become undesirably permanently adhered to carrier surfaces during developer use (often referred to as "scumming"). Another purpose of the coating is to effect the charging characteristics such as the charge stability and charging rate. However, it has been difficult to achieve all of the necessary characteristics at the same time.

Another of the characteristics that is important in the formulation of a developer is "throw-off". The term "throw-off" refers to the amount of toner powder thrown out of a developer mix as it is mechanically agitated, for example, within a development apparatus. Throw-off can cause unwanted background development and general contamination problems. Throw-off can be a function of use and can increase as the developer is used overtime to such an extent that the developer must be replaced. One possible mechanism for this increase is that the charging sites On the surface of the particles become scummed. If the throw-off of the developer can be controlled so that it does not increase unduly over time, the developer will last longer and reduce the overall cost to the user.

In U.S. Pat. No. 5,068,301 there is described a coating composition for an electrophotographic carrier. The coating composition is an organopolysiloxane.

In U.S. Pat. No. 4,977,054 there is disclosed a developer for an electrostatic image comprising a coated carrier. The coating comprises a silicone resin having a silicone containing additive selected from compounds having certain formulas.

In U.S. Pat. No. 5,200,287 there is disclosed a soft ferrite core that is coated with a coating composition comprising a silicone resin and a carbon fluoride. The carrier is said to have positive polarity without a charge control agent.

In Japanese patent publication 6/266169, there is disclosed a carrier for a negative developer which has a soft ferrite core (copper zinc ferrite) and a silicone coating with hydrophilic silica particles. Japanese patent publications JP 59232362, JP 02210365 and JP 01191155 are similar in that they have soft ferrite carrier particles coated with a filled silicone resin.

U.S. Pat. No. 4,027,073 teaches the use of silsequioxanes as abrasion resistant coatings for organic polymers.

There is a continuing need for improved hard ferrite containing carriers which have a good combination of properties, for example, good charge stability, good charging rate, and low throw off.

SUMMARY OF THE INVENTION

The present invention provides an electrostatographic carrier comprising a coated hard ferrite core, said coating comprising silicone resin and colloidal silica.

The carrier of the invention provides reduced throw off with time, and excellent charging stability and charging rate.

DETAILED DESCRIPTION

The present invention is directed to a carrier comprising hard (as opposed to soft) ferrite cores, also referred to as hard ferrite particles, that are coated with the described coating. Hard ferrite cores are known to a person of ordinary skill in the art. Hard ferrites are compounds of magnetic oxides containing iron as a major metallic component and include ferrites and gamma ferric oxide. Hard ferrites include compounds of ferric oxide, $Fe_2O_3$, formed with basic metallic oxides having the general formula $MFeO_2$ or $MFe_2O_4$ where M represents a monovalent or divalent metal and the iron is in the oxidation state of +3. Preferred hard ferrites are compounds of barium and/or strontium, such as $BaFe_{12}O_{19}$, $SrFe_{12}O_{19}$ and the magnetic ferrites having the formula $MO.6Fe_2O_3$, where M is barium, strontium or lead. U.S. Pat. No. 4,764,445 describes conductive strontium lanthanum hard ferrites.

The carrier particles comprising the hard ferrite preferably exhibit a coercivity of at least 300 gauss when magnetically saturated, preferably a coercivity of at least 500 gauss and most preferably a coercivity of at least 1000 gauss. In addition, the carrier particles preferably exhibit an induced magnetic moment of at least 20 EMU/gm based on the weight of the carrier, when in an applied field of 1000 gauss. More preferably the induced magnetic moment is at least 25 EMU/gm, most preferably from about 30 to about 60 EMU/gm, based on the weight of the carrier when in an applied field of 1000 gauss. These properties are measured as described in U.S. Pat. No. 4,546,060.

The hard ferrite cores may be solid hard ferrite particles or the hard ferrite cores may be heterogeneous and comprise small hard ferrite particles in a binder. Hard ferrite cores are further described and can be made according to the descriptions in U.S. Pat. Nos. 4,546,060, and 4,764,445, both of which are incorporated herein by reference. The hard ferrite cores are preferably about 10 to about 60 micrometers, more preferably about 20 to about 40 micrometers.

The silicone resin preferably is prepared in a manner similar to the preparation of a silsesquioxane. The coating comprises primarily silsesquioxane. Silsesquioxanes are a class of inorganic/organic glasses which can be formed at moderate temperatures by a type of procedure commonly referred to as a "sol-gel" process. In the sol-gel process, silicon alkoxides are hydrolyzed in an appropriate solvent, forming the "sol"; then the solvent is removed resulting in a condensation and the formation of a cross-linked gel. A variety of solvents can be used. Aqueous, aqueous-alcoholic, and alcoholic solutions are generally preferred. Silsesquioxanes are conveniently coated from acidic alcohols, since the silicic acid form $RSi(OH)_3$ can be stable in solution for months at ambient conditions. The extent of condensation is related to the amount of curing a sample receives, with temperature and time being among the two most important variables.

The prefix "sesqui-" refers to a one and one-half stoichiometry of oxygen and the "siloxane" indicates a silicon based material. Silsesquioxane can thus be represented by the general structure: $(RSiO_{1.5})_n$ where R is an organic group and n represents the number of repeating units. This formula, which is sometimes written $\{Si(O_{1/2})_3R\}_n$ is a useful shorthand for silsesquioxanes; but, except as to fully cured silsesquioxane, does not fully characterize the material. This is important, since silsesquioxanes can be utilized in an incompletely cured state.

To form the silicone resin of the coating composition, preferably one or more reactant silanes are mixed and cured. The silanes preferably have the structural formula:

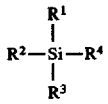

wherein $R^1$, $R^2$, $R^3$, and $R^4$ are independently selected hydrolyzable or non-hydrolyzable moieties with the proviso that at least 75%, more preferably at least 85% and most preferably at least 90% of the total number of the silanes have three hydrolyzable moieties and the remaining silanes have at least one hydrolyzable moiety. More preferably, less than 5% of the total number of the silanes in the reactant mixture have only one hydrolyzable moiety. Preferably, less than 25%, more preferably less than 20% of the total number of the silanes in the reactant mixture have two hydrolyzable moieties. It is also preferred that less than 5% of the total number of the silanes used to form the silicone resin have four hydrolyzable moieties. Further, it is preferred that the silanes that are used to form the silicone resin have a weight average molecular weight of 32 to 500, more preferably 50 to 350. Although not presently preferred, a small percentage of silicon atoms in the silanes, for example less than 20%, can be replaced by another metal, such as aluminum, titanium, zirconium, or tin, and mixed with silanes to form the silicone resin.

Hydrolyzable moieties are moieties which cleave from a silicon atom in an aqueous solution, and include alkoxides, halogens, acetoxy, hydrogen, and the like. The preferred hydrolyzable moieties are methoxy, ethoxy, and chlorine.

Non-hydrolyzable moieties are moieties which do not cleave from a silicon atom in an aqueous solution and are not capable of participation in a siloxane polycondensation reaction. Non-hydrolyzable moieties can be aromatic or nonaromatic moieties preferably having from 1 to about 12 carbons. The following monovalent or divalent moieties are examples of suitable non-hydrolyzable moieties: alkyl preferably having from 1 to about 12 carbons, haloalkyl, preferably fluoroalkyl, preferably having from 1 to about 12 carbons, cycloalkyl preferably having a single, 5 or 6 membered ring, and aryl ring systems preferably having a single 5 or 6 membered ring and from 5 to 12 carbons, including carbons of any substituents. Monovalent moieties are bonded to the Si atom of a single subunit of the polysilsesquioxane. Divalent moieties are bonded to the Si atoms of two subunits. The average number of carbons in non-hydrolyzable moieties is preferably 1 or greater, for example, non-hydrolyzable moieties can be a mixture of methyl and one or more other moieties. Specific examples of monovalent non-hydrolyzable moieties are: methyl, ethyl, n-propyl, isopropyl, n-butyl, isobutyl, t-butyl, n-decyl, perfluorooctyl, cyclohexyl, phenyl, dimethylphenyl, benzyl, napthyl, and trimethylsiloxy.

Examples of divalent non-hydrolyzable moieties are di-substituted alkyls, and di-substituted phenyls, such as

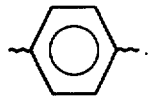

Other non-hydrolyzable moieties include heteroatoms and organofunctional moieties, with the proviso that the heteroatoms are not bonded directly to the silicon atom, but are linked through methylene units to the silicon atom. Generally these organic moieties have oxygen, nitrogen and sulfur, and a total of carbons and heteroatoms from about 4 to about 20. Many non-hydrolyzable moieties include one of the following moieties: oxy, thio, ester, keto, imino, and amino. Suitable non-hydrolyzable moieties include neutral rings and chains of ethylene oxides and propylene oxides and tetramethylene oxides and ethylene imines and alkylene sulfides, glycidoxy ethers, epoxides, pyrolidinones, amino alcohols, mines, carboxylic acids and the conjugate salts, sulfonic acids and the conjugate salts.

The preferred non-hydrolyzable moieties are methyl, ethyl, and phenyl. The most preferred non-hydrolyzable moiety is methyl.

Examples of useful silanes which can be used singly or in mixtures for making the silicone resins of this invention include alkytrialkoxysilanes, such as, methyltrimethoxysilane, ethyltrimethoxysilane, propyltrimethoxysilane, butyltrimethoxysilane, iso-butyltrimethoxysilane, methyltriethoxysilane, ethyltriethoxysilane, propyltriethoxysilane, butyltriethoxysilane, iso-butyltriethoxysilane, and methyltributoxysilane; dialkyldialkoxysilanes, such as, dimethyldimethoxysilane, and dimethyldiethoxysilane; trialkyalkoxysilanes, such as, trimethylmethoxysilane and trimethylethoxysilane; tetraalkoxysilanes, such as tetraethylorthosilicate, and tetramethylorthosilicate; aryltrialkoxysilanes, such as phenyltrimethoxysilane, and phenyltriethoxysilane, and halosilanes, such as, tetrachlorosilane, methyltrichlorosilane, dichlorodimethylsilane, and chlorotrimethylsilane. The more preferred silanes are methyltrimethoxysilane, dimethyldimethoxysilane, and ethyltrimethoxysilane. The hydrolyzable or non-hydrolyzable moieties can be the same or different on each silane or in the silane reactant mixture.

In a preferred embodiment, the silanes used to form the silicone resin comprise 75% or more of methyltrimethoxysilane and the balance 25% or less of dimethyldimethoxysilane by total weight of the silanes used to form the silicone resin.

Another component of the coating on the hard ferrite core is a colloidal silica. Colloidal silica refers to small particles of silicone dioxide carrying charge on the surface so that the particles can be dispersed in a polar liquid such as water, ethanol and/or methanol. An example of a colloidal silica that is useful in the coating is a colloidal hydrophilic silica LUDOX marketed by DuPont. Particular materials are LUDOX-LS, -SK, -TM, -CLX, -HS, -AM, -FM, and NALCO-2329, -1061, -1050, -1140, -1030, -1130, -1115 (NALCO is marketed by Nalco Chemical Co.). The colloidal silicas preferably have a particle size of less than about 100 nanometers (nm), preferably about 4 nm to about 25 nm. It is preferred that the BET surface area of the colloidal silica particles is about 40 to about 750 $m^2$/gm. The preferred colloidal silicas are stabilized by the addition of a small amount of sodium oxide, e.g. less than 1.5% by weight of the silica. Many of the commercially available colloidal silicas listed above have sodium oxide in their formulations. The colloidal silicas can contain other additives, such as, alumina, or others known to a person of ordinary skill in the art.

To make the coating composition, it is preferred to add water to the colloidal silica, then to add the colloidal silica to the hydrolyzed silane, stir the mixture, and then add the coating solvent, preferably ethanol or methanol. Reference is made to Clark, U.S. Pat. No. 4,027,073 for a method of incorporating colloidal silica into the present coatings. It was found that a number of the colloidal silicas coagulated in an ethanol coating solution but did not in a more polar solvent, e.g. methanol. The addition of water is particularly beneficial when using smaller colloidal silica particles to prevent coagulation or separation of the colloidal silica from the coating solution.

The hydrolyzed silane is made by combining the reactants, that is the silanes, used to make the silicone resin, and adding an acid to the reactant mixture to acidify the mixture to a pH preferably less than 5, more preferably 1.5 and 4. Water is then added to the mixture to hydrolyze the silanes.

The silicone resin is present in the range of about 50% to 95% by weight solids of the total weight of the solids in the coating composition (assuming complete hydrolysis of the hydrolyzable silanes), and the colloidal silica is present in the range of 1% to about 50%, preferably 20% to 40% of the total solids content of the coating composition based on the weight of dry $SiO_2$ in the colloidal silica. The preferred proportion is 70% to 80% silicone resin and 20% to 30% colloidal silica based on the total weight of the solids in the coating composition.

The coating can contain other additives such as release agents, such as for example stearic acid; humectants such as polyethylene glycol and similar compounds; adhesion promoters; catalysts and the like. An additional benefit of this invention is that good adhesion of the coating is achieved to non-primed hard ferrite cores, meaning that primers or adhesion promoters applied to the hard ferrite cores or added to coating composition are not necessary to obtain good adhesion of the coating to the hard ferrite cores.

The hard ferrite cores are coated by adding the coating composition to them. This mixture of carrier particles and coating composition is preferably stirred in the presence of air and slight heat to dry the coating onto the surfaces of the hard ferrite particles. The coating is then allowed to cure further at elevated temperature. The amount of solids in the coating composition depends on the final desired amount of dry coating on the hard ferrite cores, and weight of the cores added to the coating composition. The amount of solvent in the coating composition should be enough to thoroughly wet the carrier particles. Alternatively, the coating can be applied using a fluidized bed, by spray coating or other techniques known in the art. For these methods, the amount of solvent needed for the coating composition can be determined by ordinary experimentation based on the method used to coat the cores.

The weight percent of the dry coating composition on the cores is based on the weight of hard ferrite cores and is typically within the range of about 0.5 weight % to about 4.0 weight %. The preferred amount will be determined by the surface area of the specific hard ferrite that is used. Where the surface area is high, higher amounts of the coating can be used. Conversely, where the surface area of the ferrite particles is low, lower amounts of the coating should be used. The preferred amount is about 1.5 weight % to 2.5 weight % by weight of the cores using a core having a BET (standard measurement of surface area in $m^2$/g) of about 2000. The coating can be a continuous or discontinuous layer on the hard ferrite cores.

The coated carrier particles of this invention are used in a developer which consists of the carrier particles and toner. The carrier particles are preferably 80 to 99% by weight of the developer, and the toner is preferably 1 to 20% by weight of the developer. The carrier can be used with toners which become triboelectronegatively or triboelectropositively charged when mixed with carrier. Useful mixing devices include roll mills, auger mixers, and other high energy mixing devices. Preferably the coated carrier particles are used with electronegatively charging toners. Usually, carrier particles are larger than toner particles. The carrier particles preferably have a particle size of from about 5 to about 1200 micrometers, more preferably from 20 to 200 micrometers. The toner preferably has a particle size of 2 to 30 micrometers, preferably 3 to 15 micrometers.

The term "particle size" used herein, or the term "size", or "sized" as employed herein in reference to the term "particles", means the median volume weighted diameter as measured by conventional diameter measuring devices, such as a Coulter Multisizer, sold by Coulter, Inc. of Hialeah, Fla. Median volume weighted diameter is the diameter of an equivalent weight spherical particle which represents the median for a sample.

The coated carrier particles can be used with any toners to make developers. Toners typically comprise at least a toner binder. Useful toner binder polymers include vinyl polymers, such as homopolymers and copolymers of styrene and condensation polymers such as polyesters and copolyesters. Particularly useful binder polymers are styrene polymers of from 40 to 100 percent by weight of styrene or styrene homologs and from 0 to 45 percent by weight of one or more lower alkylacrylates, methacrylates, or butadiene. Fusible styrene-acrylic copolymers which are covalently lightly crosslinked with a divinyl compound such as divinylbenzene, as disclosed in U.S. Pat. No. Re. 31,072, are particularly useful. Also especially useful are polyesters of aromatic dicarboxylic acids with one or more aliphatic diols, such as polyesters of isophthalic or terephthalic acid with diols such as ethylene glycol, cyclohexane dimethanol and bisphenols.

Another useful binder polymer composition comprises:

a) a copolymer of a vinyl aromatic monomer; a second monomer selected from the group consisting of i) conjugated diene monomers and ii) acrylate monomers selected from the group consisting of alkyl acrylate monomers and alkyl methacrylate monomers; and b) the acid form of an amino acid soap which is the salt of an alkyl sarcosine having an alkyl group which contains from about 10 to about 20 carbon atoms. Binder polymer compositions of this type having a third monomer which is a crosslinking agent are described in U.S. Provisional application Ser. No. 60/001,632 entitled TONER COMPOSITIONS INCLUDING CROSSLINKED POLYMER BINDERS and filed in the names of Tyagi and Hadcock. Binders of this type not having a third monomer which is a crosslinking agent are made in accordance with the process described in U.S. Pat. No. 5,247,034 except that the copolymer includes a crosslinking agent.

Binder materials that are useful in the toner particles used in the method of this invention can be amorphous or semicrystalline polymers. The amorphous toner binder compositions have a Tg in the range of about 45° C. to 120° C., and often about 50° C. to 70° C. The useful semi-crystalline polymers have a Tm in the range of about 50° to 150° C. and more preferably 60° C. to 125° C. The thermal characteristics, such as Tg and Tm, can be determined by any conventional method, e.g., differential scanning calorimetry (DSC).

Numerous colorant materials selected from dyestuffs or pigments can be employed in the toner particles used in the invention. Such materials serve to color the toner and/or render it more visible. Suitable toners can be prepared without the use of a colorant material where it is desired to have developed toner image of low optical densities. In those instances where it is desired to utilize a colorant, the colorants can, in principle be selected from virtually any of the compounds mentioned in the Colour Index Volumes 1 and 2, Second Edition. Suitable colorants include those typically employed in cyan, magenta and yellow colored toners. Such dyes and pigments are disclosed, for example, in U.S. No. Re. 31,072 and in U.S. Pat. Nos. 4,160,644; 4,416,965; 4,414,152; and 2,229,513. One particularly useful colorant for toners to be used in black and white electrostatographic copying machines and printers is carbon black. The amount of colorant added may vary over a wide range, for example, from about 1 to 40 percent of the weight of binder polymer used in the toner particles. Mixtures of colorants can also be used.

Another optional component of the toner composition is a charge control agent. The term "charge control" refers to a propensity of a toner addendum to modify the triboelectric charging properties of the resulting toner. A very wide variety of charge control agents for positive charging toners are available. A large, but lesser number of charge control agents for negative charging toners is also available. Suitable charge control agents are disclosed, for example, in U.S. Pat. Nos. 3,893,935; 4,079,014; 4,323,634; 4,394,430 and British Patent Nos. 1,501,065; and 1,420,839. Charge control agents are generally employed in small quantities such as, from about 0.1 to about 5 weight percent based upon the weight of the toner. Additional charge control agents which are useful are described in U.S. Pat. Nos. 4,624,907; 4,814,250; 4,840,864; 4,834,920; 4,683,188 and 4,780,553. Mixtures of charge control agents can also be used.

Another component which can be present in the toner composition useful in this invention is an aliphatic amide or aliphatic acid. Suitable aliphatic amides and aliphatic acids are described, for example, in *Practical Organic Chemistry*, Arthur I. Vogel, 3rd Ed. John Wiley and Sons, Inc. N.Y. (1962); and *Thermoplastic Additives: Theory and Practice* John T. Lutz Jr. Ed., Marcel Dekker, Inc, N.Y. (1989). Particularly useful aliphatic amide or aliphatic acids have from 8 to about 24 carbon atoms in the aliphatic chain. Examples of useful aliphatic amides and aliphatic acids include oleamide, eucamide, stearamide, behenamide, ethylene bis(oleamide), ethylene bis(stearamide), ethylene bis (behenamide) and long chain acids including stearic, lauric, montanic, behenic, oleic and tall oil acids. Particularly preferred aliphatic amides and acids include stearamide, erucamide, ethylene bis-stearamide and stearic acid. The aliphatic amide or aliphatic acid is present in an amount from about 0.5 to 30 percent by weight, preferably from about 0.5 to 8 percent by weight. Mixtures of aliphatic amides and aliphatic acids can also be used. One useful stearamide is commercially available from Witco Corporation as KEMAMIDE S. A useful stearic acid is available from Witco Corporation as HYSTERENE 9718.

The toner can also contain other additives, including magnetic pigments, leveling agents, surfactants, stabilizers, and the like. The total quantity of such additives can vary. A present preference is to employ not more than about 10 weight percent of such additives on a total toner powder composition weight basis. Toners can optionally incorporate a small quantity of low surface energy material, as described in U.S. Pat. Nos. 4,517,272 and 4,758,491.

The toner compositions useful with the carrier particles of the invention can be made with a process that is a modification of the evaporative limited coalescence process described in U.S. Pat. No. 4,883,060, the disclosure of which is hereby incorporated by reference. Alternatively, the toners can be commercially obtained from Eastman Kodak Co. and other toner manufacturers.

The toner can also be surface treated with small inorganic particles to impart powder flow or cleaning or improved transfer. Toners having transfer assisting addenda are commercially available from Ricoh, Cannon and other toner manufacturers or can be produced by the numerous methods disclosed in the prior art.

The coated carrier cores of this invention are preferably used in developer compositions for electrostatographic development of toner images. For this use the developers can be mixed by any known toning station to triboelectrically charge the toner. It is preferred to use a rotating-core magnetic applicator which comprises a core-shell arrangement to apply the toner to an electrophotographic element.

The core of the applicator is a multipolar magnetic core, meaning that it comprises a circumferential array of magnets disposed in a north-south-north-south polar configuration facing radially outward. The core is rotatably housed within the outer shell. The shell is composed of a nonmagnetizedable material which serves as the carrying surface for the developer composition. As the core rotates in the shell, the two component developer rapidly flips due to the rotating magnets in the core. Magnetic applicators having a rotating core are further described in U.S. Pat. Nos. 4,235,194; 4,239,845 and 3,552,355, incorporated herein by reference.

The following examples are presented to further illustrate the coated carrier of this invention.

EXAMPLE 1

Silicone resin was prepared by stirring about 10 ml of trimethoxy silane ($CH_3Si(OCH_3)_3$ with 0.4 ml of glacial acetic acid and 0.1 ml of dilute HCl (1 ml of concentrated HCl in 50 ml with distilled water). To this was added, while stirring, 3 ml of distilled water. An exothermic reaction promptly took place. The hydrolyzed silane solution was stirred for an additional hour before using. The final solution contained ~51.4% hydrolyzed silane. 70% by weight hydrolyzed silane was mixed with 30% by weight LUDOX LS-30 colloidal silica (30% solids) to form the coating composition. LUDOX LS-30 has a particle size of about 12 nm.

The coating composition having 1 gram of solids dispersed in about 13 ml of ethanol was added to 50 grams of strontium ferrite cores having an average particle size of about 32 micrometers made according to U.S. Pat. No. 4,546,060. The ferrite cores and coating composition were mixed in the presence of air and slight heat to evaporate off the solvent. When the coating composition dried, it was cured for 2 hours at 190° C. The carrier was then allowed to cool, and was sieved to break up any agglomerates. The final coated carrier contained about 2 parts per hundred (pph) by weight of carrier coating.

The coated carrier was mixed with a negative charging toner at 12% toner concentration to make a developer. The toner consisted of 6 pph Regal 300 carbon, available from Cabot Corporation, 2 pph CCA-7 charge agent available from ICI, and 100 pph styrene, butylacrylate, divinylbenzene (77/23/0.3) polymer. The polymer was made according to the method disclosed in U.S. Pat. No. 3,938,992, incorporated herein by reference.

Toner charge was measured in microcoulombs per gram (μc/g) in a "MECCA" device for two exercise time periods, designated "3 min Q/m" and "10 min Q/m". Prior to measuring the toner charge, the developer was vigorously shaken (exercised) to cause triboelectric charging by placing a 4 gram sample of developer (3.52 grams carrier, 0.48 grams toner) into a 4 dram glass screw cap vial, capping the vial and shaking the vial on a "wrist-action" robot shaker operated at about 2 Hertz and an overall amplitude of about 11 cm for 3 minutes. Toner charge level after shaking was then measured by placing a 100 milligram sample of the charge developer in a MECCA and measuring the charge and mass of the transferred toner in the MECCA. This measurement was made by the MECCA by placing the 100 milligram sample of the charged developer in a sample dish between electrode plates. The sample was subjected for 30 seconds, simultaneously to a potential of 2,000 Volts across the plates, and to a 60 Hz magnetic field which caused the developer to agitate. The toner was released from the carrier and was attracted to and collected on the plate having polarity opposite to the toner charge. The total toner charge was measured by an electrometer connected to the plate, and that value was divided by the weight of the toner on the plate to yield the charge per mass of the toner (Q/m). This measurement is "3 min Q/m".

The toner charge level (Q/m) was also measured after exercising the developer for 10 minutes by placing the same developer sample used for determining the 3 min Q/m in a 4 dram vial on top of a rotating-core magnetic brash. The bottle was held in place while the magnetic core rotated at 2000 revolutions per minute. (This closely approximates typical usage of the developer in an electrostatographic development process.) The developer was exercised as if it were directly on a magnetic brush, but without any loss of the developer, because it was contained in the vial. The 30 sec Mecca charge was then repeated at the end of the 10 min. for the developer. This test is the "10 min Q/m."

The next test was the Admix Dust test. After the 10 min Q/m was determined enough fresh toner was added to the remainder of the developer to bring the final concentration of the developer to 18% toner concentration. This developer was stirred very slightly (about 10 light turns with a spatula) and the developer was then shaken for 15 sec. and placed on a small magnetic brash and exercised for 1 min. at 2000 RPM's. A Buchner funnel with a preweighed piece of filter paper (held in place with a slight vacuum) was held in place over the top of the rotating brush and any toner dust that was thrown off was collected and weighed. The weight of the toner is listed in the table under "Admix Dust Test". The Admix Dust Test simulates what would happen in a copier in which high toner throughput would demand the addition of fresh toner to a developer. If the changing rate is not fast enough, toner dusting will occur.

The 3 min Q/m, 10 min Q/m, and Admix Dust Test were measured for carrier subject to three aging periods: (a) no aging, (b) 16 hours "overnight" (1-O.N.), and (c) 2 overnights (2-O.N.).

The measurements for carrier that was not aged were performed as described above.

To age the carriers for 16 hours (1-O.N.), a fresh sample of 5.28 g. of magnetized, experimental carrier was shaken with 0.72 g of toner (in a 4 dram screw cap vial) and then exercised on a magnetic brush for 16 hrs. At the end of the 16 hrs.; the carrier was electrically stripped of essentially all of the exercised toner in a 5.5 kilovolt field. 0.48 grams of fresh toner were added to 3.52 grams of the stripped carrier, and the 3 min Q/m, 10 min Q/m, and the Admix Dust Test were performed as described above.

To age the carrier for two overnights (2-O.N.), the carrier in the developer used for the 1-O.N. tests was stripped of toner again as described above and fresh toner was added to the carrier to provide a developer having 12% toner concentration and the developer was exercised for a second 16 hours, then the carrier and the toner of the developer were separated again as described above and fresh toner was added to the carrier to provide a developer having a 12% toner concentration. Again the 3 min Q/m, 10 min. Q/m, and the Admix Dust Test were performed as described above.

The carriers were magnetized to saturation by placing them in a Model 595 High Power-Magnetreater/Charger manufactured by RFL Industries Inc.

The results for the testing performed on Example 1 are listed in Table 1.

EXAMPLE 2

Example 1 was repeated except that methanol was used instead of ethanol as the coating solvent.

The same tests described in Example 1 were performed on the coated carriers of Example 2 and the results are listed in Table 1.

EXAMPLE 3

Example 2 was repeated except that LUDOX SM-30 was used instead of LUDOX LS-30. LUDOX SM-30 has a particle size of about 7 nm.

The same tests described in Example 1 were performed on the coated carriers of Example 3 and the results are listed in Table 1.

EXAMPLE 4

Example 2 was repeated except that NALCO 1115 was used instead of LUDOX LS-30. NALCO 1115 has a particle size of about 4 nm.

The same tests described in Example 1 were performed on the coated carriers of Example 4 and the results are listed in Table 1.

EXAMPLE 5

Example 1 was repeated except that 80% by weight hydrolyzed silane was mixed with 20% by weight LUDOX LS-30 colloidal silica.

The same tests described in Example 1 were performed on the coated carriers of Example 5 and the results are listed in Table 1.

EXAMPLE 6

Example 1 was repeated except that 90% by weight hydrolyzed silane was mixed with 10% by weight LUDOX LS-30 colloidal silica.

The same tests described in Example 1 were performed on the coated carriers of Example 6 and the results are listed in Table 1.

COMPARATIVE EXAMPLE 1

Example 1 was repeated except that no colloidal silica was added to the coating composition. The final coating was still about 2 pph by weight of the carriers.

The same tests described in Example 1 were performed on the coated carriers of Comparative Example 1 and the results are listed in Table 1.

COMPARATIVE EXAMPLE 2/3/4

Example 2 was repeated except that no colloidal silica was added to the coating composition. The final coating was still about 2 pph by weight of the carriers.

The same tests described in Example 1 were performed on the coated carriers of Comparative Example 2/3/4 and the results are listed in Table 1.

TABLE 1

| Example No. | Age of Carrier | 3 Min Q/m (μC/g) | 10 Min. Q/m (μC/g) | Admix Dust Test (mg) | Particle Size (nm) of Colloidal Silica |
|---|---|---|---|---|---|
| Example 1 | No Aging | −22.5 | −23.1 | 8 | ~12 |
| Example 1 | 1-O.N. | −15.7 | −21.2 | 20.8 | ~12 |
| Example 1 | 2-O.N. | −15 | −22.5 | 45.7 | ~12 |
| Example 2 | No Aging | −22.9 | −22.5 | 9 | ~12 |
| Example 2 | 1-O.N. | −15.2 | −21.3 | 13.4 | ~12 |

TABLE 1-continued

| Example No. | Age of Carrier | 3 Min Q/m (μC/g) | 10 Min. Q/m (μC/g) | Admix Dust Test (mg) | Particle Size (nm) of Colloidal Silica |
|---|---|---|---|---|---|
| Example 2 | 2-O.N. | −16.7 | −23.1 | 28.7 | ~12 |
| Example 3 | No Aging | −23.1 | −19.1 | 2.8 | ~7 |
| Example 3 | 1-O.N. | −15.7 | −21.2 | 6.6 | ~7 |
| Example 3 | 2-O.N. | −17.9 | −23.7 | 19.9 | ~7 |
| Example 4 | No Aging | −22.2 | −24 | 1.8 | ~4 |
| Example 4 | 1-O.N. | −18.2 | −21 | 4.8 | ~4 |
| Example 4 | 2-O.N. | −18 | −20.6 | 12.5 | ~4 |
| Example 5 | No aging | −19.1 | −20.3 | 11.8 | ~12 |
| Example 5 | 1-O.N. | −14.9 | −20.4 | 37.4 | ~12 |
| Example 5 | 2-O.N. | −13.6 | −20.4 | 64.2 | ~12 |
| Example 6 | No Aging | −18.1 | −19.2 | 17.9 | ~12 |
| Example 6 | 1-O.N. | −14.1 | −20.4 | 47.6 | ~12 |
| Example 6 | 2-O.N. | −13.4 | −20.5 | 71.6 | ~12 |
| Comparative Ex. 1 | No Aging | −24.4 | −31.3 | 19.6 | None |
| Comparative Ex. 1 | 1-O.N. | −14.3 | −20.3 | 48.6 | None |
| Comparative Ex. 1 | 2-O.N. | −12.4 | −19.7 | 72.1 | None |
| Comp. Ex. 2/3/4 | No Aging | −28 | −46 | 7 | None |
| Comp. Ex. 2/3/4 | 1-O.N. | −20.3 | −26.4 | 23.7 | None |
| Comp. Ex. 2/3/4 | 2-O.N. | −16.5 | −23.5 | 50.6 | None |

EXAMPLE 7

Example 2 was repeated except that the strontium ferrite cores used in Example 2 were replaced with the strontium lanthanum ferrite cores having a particle size of 30 micrometers, and made according to U.S. Pat. No. 4,764,445.

The same tests described in Example 1 were performed on the coated carriers of Example 7 and the results are listed in Table 2.

EXAMPLE 8

Example 7 was repeated except that LUDOX SM-30 was used instead of LUDOX LS-30.

The same tests described in Example 1 were performed on the coated carriers of Example 8 and the results are listed in Table 2.

COMPARATIVE EXAMPLE 7

Example 7 was repeated except that no colloidal silica was added to the coating composition. The final coating was still about 2 pph by weight of the carriers.

The same tests described in Example 1 were performed on the coated carriers of Comparative Example 7 and the results are listed in Table 2.

TABLE 2

| Example No. | Age of Carrier | 3 Min Q/m (μC/g) | 10 Min. Q/m (μC/g) | Admix Dust Test (mg) | Particle Size of Colloidal Silica (nm) |
|---|---|---|---|---|---|
| Eample 7 | No Aging | −14.6 | −17.6 | 2.8 | 12 |
| Eample 7 | 1-O.N. | −13 | −19.2 | 26.3 | 12 |
| Eample 7 | 2-O.N. | −15.1 | −22.6 | 32.1 | 12 |
| Eample 8 | No Aging | −14.7 | −14.7 | 8.1 | 7 |

TABLE 2-continued

| Example No. | Age of Carrier | 3 Min Q/m (μC/g) | 10 Min. Q/m (μC/g) | Admix Dust Test (mg) | Particle Size of Colloidal Silica (nm) |
|---|---|---|---|---|---|
| Eample 8 | 1-O.N. | −12.2 | −17 | 11.3 | 7 |
| Eample 8 | 2-O.N. | −14.1 | −19.1 | 15.7 | 7 |
| Comparative Ex. 7 | No Aging | −18.3 | −28.7 | 39.7 | None |
| Comparative Ex. 7 | 1-O.N. | −14.6 | −19.7 | 33.6 | None |
| Comparative Ex. 7 | 2-O.N. | −15.2 | −19.8 | 43.4 | None |

EXAMPLE 9

Example 2 was repeated except that 10 ml of methyltrimethoxysilane ($CH_3Si(OCH_3)_3$) was mixed with 1.1 ml of dimethyldimethoxysilane ($(CH_3)_2Si(OCH_3)_2$) and substituted for the methyltrimethoxysilane in the hydrolyzed silane of Example 2. The final hydrolyzed silane solution was ~52.3% solids and contained a 90%/10% by weight mixture of $(CH_3Si(OH)_3)/(CH_3)_2Si(OH)_2$.

The same tests described in Example 1 were performed on the coated carriers of Example 9 and the results are listed in Table 3.

COMPARATIVE EXAMPLE 9

Example 9 was repeated except that no colloidal silica was added to the coating composition.

The same tests described in Example 1 were performed on the coated carriers of Comparative Example 9 and the results are listed in Table 3.

TABLE 3

| Example No. | Age of Carrier | 3 Min Q/m (μC/g) | 10 Min. Q/m (μC/g) | Admix Dust Test (mg) | Particle Size of Colloidal Silica (nm) |
|---|---|---|---|---|---|
| Eample 9 | No Aging | −23.2 | −25.8 | 6.2 | 12 |
| Eample 9 | 1-O.N. | −14.5 | −21.3 | 12.1 | 12 |
| Eample 9 | 2-O.N. | −15.5 | −21.1 | 25.5 | 12 |
| Comparative Ex. 9 | No Aging | −26.7 | −42 | 9.6 | None |
| Comparative Ex. 9 | 1-O.N. | −17.6 | −23.2 | 25.5 | None |
| Comparative Ex. 9 | 2-O.N. | −12.8 | −20.6 | 48.1 | None |

EXAMPLE 10

Example 1 was repeated except that 10 ml of isobutyltrimethoxysilane ($(CH_3)_2CHCH_2Si(OCH_3)_2$) was substituted for the methyltrimethoxysilane in the hydrolyzed silane of Example 1. The final hydrolyzed silane solution was ~46.6% solids. 80% by weight hydrolyzed silane was mixed with 20% by weight LUDOX LS-30 colloidal silica to form the coating composition.

The same tests described in Example 1 were performed on the coated carriers of Example 10 and the results are listed in Table 4.

COMPARATIVE EXAMPLE 10

Example 10 was repeated except that no colloidal silica was added to the coating composition.

The same tests described in Example 1 were performed on the coated carriers of Comparative Example 10 and the results are listed in Table 4.

TABLE 4

| Example No. | Age of Carrier | 3 Min Q/m (μC/g) | 10 Min. Q/m (μC/g) | Admix Dust Test (mg) | Particle Size of Colloidal Silica (nm) |
|---|---|---|---|---|---|
| Eample 10 | No Aging | −14.1 | −23.7 | 4.1 | 12 |
| Eample 10 | 1-O.N. | −18.7 | −20.8 | 22.5 | 12 |
| Eample 10 | 2-O.N. | −16.4 | −20.4 | 31.3 | 12 |
| Comparative Ex. 10 | No Aging | −18.2 | −34.2 | 12.7 | None |
| Comparative Ex. 10 | 1-O.N. | −17.0 | −22.3 | 39.1 | None |
| Comparative Ex. 10 | 2-O.N. | −17.6 | −21.1 | 50.4 | None |

COMPARATIVE EXAMPLE 3A

The coating composition was prepared as described for Example 3 except that the colloidal silica was replaced with fumed silica (dry powder), AEROSIL-200 having a primary particle size of about 12 nm. The fumed silica was dispersed in the coating composition by sonication using a Sonifier Cell Disrupter (Model W-185), manufactured by Branson Sonic Power Company. The coating solution was sonicated (3×) for about one minute each time using the micro tip probe, with shaking between each sonication to make sure that any larger silica particles were removed from the upper vial walls and were sonicated. The coating composition was then coated onto the carrier as described in Example 2. The final coated carrier contained about 2 parts per hundred (pph) by weight of carrier coating.

The same tests described in Example 1 were performed on the coated carriers of Comparative Example 3A and the results are listed in Table 5.

COMPARATIVE EXAMPLE 3B

The coating composition was prepared as described for Comparative Example 3A except that AEROSOL-300 having a primary particle size of about 7 nm was used in the coating composition, instead of AEROSIL-200.

The same tests described in Example 1 were performed on the coated carriers of Comparative Example 3B and the results are listed in Table 5.

COMPARATIVE EXAMPLE 3C

The coating composition was prepared as described for Comparative Example 3A except that AEROSIL-380 having a primary particle size of about 5 nm was used in the coating composition, instead of AEROSIL-200.

The same tests described in Example 1 were performed on the coated carriers of Comparative Example 3C and the results are listed in Table 5.

TABLE 5

| Example No. | Age of Carrier | 3 Min Q/m (μC/g) | 10 Min. Q/m (μC/g) | Admix Dust Test (mg) | Particle Size of Fumed Silica (nm) |
|---|---|---|---|---|---|
| Comparative Ex. 3A | No Aging | −31.6 | −53.2 | 5.1 | 12 |
| Comparative Ex. 3A | 1-O.N. | −19.9 | −26.8 | 29.5 | 12 |
| Comparative Ex. 3A | 2-O.N. | −17.6 | −25.6 | 52.5 | 12 |
| Comparative Ex. 3B | No Aging | −29.3 | −54 | 6.2 | 7 |
| Comparative Ex. 3B | 1-O.N. | −20.5 | −28.3 | 20.8 | 7 |
| Comparative Ex. 3B | 2-O.N. | −19 | −24.3 | 38.6 | 7 |
| Comparative Ex. 3C | No Aging | −29.7 | −53.6 | 5 | 5 |
| Comparative Ex. 3C | 1-O.N. | −21.5 | −29 | 22 | 5 |
| Comparative Ex. 3C | 2-O.N. | −18.2 | −24.7 | 42.4 | 5 |

The testing results in Tables 1 to 5 indicate that the carriers having a coating comprising silicone resin and the colloidal silica provided good charge stability and low toner throw off. Good charge stability for a carrier is evidenced by recorded values for the 3 Min Q/m tests for No Aging, 1-O.N. and 2-O.N. which are close together. The recorded values are considered close together when the difference between the highest and lowest Q/m is less than 10 μC/g, more preferably less 8 μC/g and most preferably less than 5 μC/g. Even more importantly good charge stability is evidenced by reported Values for the 10 Min Q/m tests for No Aging, 1-O.N. and 2-O.N. which are close together. Tables 1 to 4 show that the values for the 3 Min Q/m and the 10 Min Q/m for all the Examples of the invention differ by less than 8 μC/g and most differed by less than 5 μC/g. On the other hand, most of the results for the 3 Min Q/m and the 10 Min Q/m tests for the Comparative Examples in Tables 1 to 5 differ by greater than 10 μC/g. The Examples therefore show better charge stability than the Comparative Examples.

The lower the Admix Dust Test results, the lower the toner throw off, and the faster the charging rate for the additional toner added to the developer during the test. The results in Tables 1 to 5 indicate that the carriers of the invention provide lower toner throw off as compared to the Comparative Examples. For examples, Example 1, which is the same as Comparative Example 1 except that Example 1 contains colloidal silica, had a maximum dusting value of 45.7 mg, whereas Comparative Example 1 had a maximum dusting value of 72.1 mg, and Example 2, which is the same as Comparative Example 2 except that Example 2 contains colloidal silica, had a maximum dusting value of 28.7 mg, whereas Comparative Example 2 had a maximum dusting value of 50.6 mg. These examples and others in the tables indicate that lower toner throw off is provided by the carriers of this invention. Therefore, the results in Tables 1 to 5 indicate that the coated carriers of this invention provide both improved charging stability and lower toner throw off than carriers not of the invention.

Table 5 shows that little or no improved charge stability and decreased toner throw off is provided when fumed silica is used in the coating composition instead of colloidal silica.

The invention has been described with particular reference to preferred embodiments thereof but it will be understood that variations and modifications can be effected within the spirit and scope of the invention.

We claim:

1. An electrostatographic carrier composition comprising coated hard ferrite cores, said coating comprising silicone resin and colloidal silica.

2. An electrostatic carrier according to claim 1 wherein said colloidal silica has a particle size of less than 100 nm.

3. An electrostatic carrier according to claim 1 wherein said colloidal silica has a particle size of about 4 nm to 25 nm.

4. An electrostatic carrier according to claim 1 wherein said colloidal silica has a particle surface area of about 40 $m^2$/gram to about 750 $m^2$/gram.

5. An electrostatic carrier according to claim 1 wherein a compound selected from the group consisting of sodium oxide and alumina is added to said colloidal silica.

6. An electrostatic carrier according to claim 1 wherein said silicone resin is formed from crosslinking reactants, said reactants comprising silanes having the structural formula:

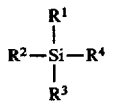

wherein $R^1$, $R^2$, $R^3$, and $R^4$ are independently selected hydrolyzable or non-hydrolyzable moieties with the proviso that at least 75% of the total number of said silanes have three hydrolyzable moieties and the remaining silanes have at least one hydrolyzable moiety.

7. An electrostatic carrier according to claim 6 wherein at least 85% of the total number of said silanes have three hydrolyzable moieties and less than 5% of the total number of said silanes have only one hydrolyzable moiety, and less than 5% of the total number of said silanes have four hydrolyzable moieties.

8. An electrostatic carrier according to claim 6 wherein at least 90% of the total number of said silanes have three hydrolyzable moieties.

9. An electrostatic carrier according to claim 6 wherein said hydrolyzable moieties are selected from the group consisting of alkoxides, halogens, acetoxy, and hydrogen.

10. An electrostatic carrier according to claim 6 wherein said non-hydrolyzable moieties are monovalent or divalent and are selected from the group consisting of alkyl, haloalkyl, cycloalkyl, and aryl.

11. An electrostatic carrier according to claim 6 wherein said non-hydrolyzable moieties are monovalent or divalent and are selected from the group consisting of methyl, ethyl, n-propyl, isopropyl, n-butyl, isobutyl, t-butyl, n-decyl, perfluorooctyl, cyclohexyl, phenyl, dimethylphenyl, benzyl, napthyl, and trimethylsiloxy.

12. An electrostatic carrier according to claim 1 wherein said silicone resin is formed from crosslinking reactants, said reactants comprising silanes selected from the group consisting of alkytrialkoxysilanes, dialkyldialkoxysilanes, trialkylalkoxysilanes, tetraalkoxysilanes, aryltrialkoxysilanes, and halosilanes.

13. An electrostatic carrier according to claim 1 wherein said silicone resin is formed from crosslinking reactants, said reactants comprising silanes selected from the group consisting of methyltrimethoxysilane, ethyltrimethoxysilane, propyltrimethoxysilane, butyltrimethoxysilane, iso-butyltrimethoxysilane, methyltriethoxysilane, ethyltriethoxysilane, propyltriethoxysilane, butyltriethoxysilane, iso-butyltriethoxysilane, methyltributoxysilane, dimethyldimethoxysilane, dimethyldiethoxysilane, trimethylmethoxysilane, trimethylethoxysilane, tetraethylorthosilicate, tetramethylorthosilicate, phenyltrimethoxysilane, phenyltriethoxysilane, tetrachlorosilane, methyltrichlorosilane, dichlorodimethylsilane, and chlorotrimethylsilane.

14. An electrostatic carrier according to claim 1 wherein said silicone resin is formed from crosslinking reactants, said reactants comprising silanes selected from the group consisting of methyltrimethoxysilane, dimethyldimethoxysilane, and ethyltrimethoxysilane.

15. An electrostatic carrier according to claim 14 wherein said silicone resin is formed from crosslinking reactants comprising silanes, said reactants comprising 75% or more methyltrimethoxysilane, and 25% or less dimethyldimethoxysilane by total weight of said silanes in said reactants.

16. An electrostatic carrier according to claim 1 wherein said hard ferrite cores exhibit an induced magnetic moment of at least 20 EMU/gram based on the weight of the carrier when in an applied field of 1000 gauss.

17. An electrostatic carrier according to claim 1 wherein said hard ferrite cores comprise strontium, barium, lanthanum or lead.

18. An electrostatic carrier according to claim 1 wherein 1% to about 50% by total weight solids of said coating comprises said colloidal silica based on the weight of dry $SiO_2$ in said colloidal silica.

19. An electrostatic carrier according to claim 1 wherein 20% to about 30% by total weight solids of said coating comprises said colloidal silica based on the weight of dry $SiO_2$ in said colloidal silica.

20. A developer composition comprising the carrier composition of claim 1 and toner.

21. An electrostatic carrier comprising coated hard ferrite cores said coating comprising silicone resin and colloidal silica, said hard ferrite cores exhibit an induced magnetic moment of at least 20 EMU/gram based on the weight of the carrier when in an applied field of 1000 gauss, said silicone resin is formed from crosslinking reactants, said reactants comprising silanes having the structural formula:

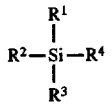

wherein $R^1$, $R^2$, $R^3$, and $R^4$ are independently selected hydrolyzable or non-hydrolyzable moieties with the proviso that at least 75% of the total number of said silanes have three hydrolyzable moieties and the remaining silanes have at least one hydrolyzable moiety, less than 5% of the total number of said silanes have only one hydrolyzable moiety, and less than 5% of the total number of said silanes have four hydrolyzable moieties, and said colloidal silica has a particle surface area of 40 $m^2$/gram to 750 $m^2$/gram.

* * * * *